US008337178B2

(12) United States Patent
Boecking

(10) Patent No.: US 8,337,178 B2
(45) Date of Patent: Dec. 25, 2012

(54) PUMP, PARTICULARLY HIGH-PRESSURE FUEL PUMP

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 310 days.

(21) Appl. No.: 12/673,500

(22) PCT Filed: Aug. 1, 2008

(86) PCT No.: PCT/EP2008/060172

§ 371 (c)(1),
(2), (4) Date: Feb. 14, 2010

(87) PCT Pub. No.: WO2009/021865

PCT Pub. Date: Feb. 19, 2009

(65) Prior Publication Data

US 2011/0200463 A1 Aug. 18, 2011

(30) Foreign Application Priority Data

Aug. 16, 2007 (DE) ..... 10 2007 038 525

(51) Int. Cl.
*F04B 37/00* (2006.01)
*F04B 19/00* (2006.01)

(52) U.S. Cl. ..... 417/471; 92/130 C

(58) Field of Classification Search ..... 417/470, 417/471, 570, 571; 92/72, 73, 130 C
See application file for complete search history.

(56) References Cited

U.S. PATENT DOCUMENTS

| | | | | |
|---|---|---|---|---|
| 1,893,216 | A * | 1/1933 | Babitch | 74/53 |
| 1,893,217 | A * | 1/1933 | Babitch | 74/53 |
| 2,036,452 | A * | 4/1936 | Babitch et al. | 74/18.1 |
| 2,139,347 | A * | 12/1938 | Babitch et al. | 417/571 |
| 2,359,960 | A * | 10/1944 | Anderson | 92/129 |
| 3,314,365 | A * | 4/1967 | Ritchie | 417/471 |
| 3,924,970 | A * | 12/1975 | Johnston et al. | 417/220 |
| 5,897,302 | A | 4/1999 | Siegel et al. | |
| 6,450,788 | B1 | 9/2002 | Grabert | |
| 6,506,033 | B2 * | 1/2003 | Fukami | 417/420 |
| 6,655,933 | B2 * | 12/2003 | Chiba | 417/471 |
| 2011/0023704 | A1 * | 2/2011 | Boecking | 92/129 |

FOREIGN PATENT DOCUMENTS

| | | | |
|---|---|---|---|
| DE | 7305570 | U | 8/1973 |
| DE | 19503621 | A1 | 8/1996 |
| DE | 19848040 | A1 | 4/2000 |

* cited by examiner

*Primary Examiner* — Charles Freay
*Assistant Examiner* — Christopher Maxey
(74) *Attorney, Agent, or Firm* — Michael Best & Friedrich LLP

(57) ABSTRACT

The invention relates to a pump, particularly a high-pressure fuel pump, having a housing, a drive shaft that is rotationally driven and has at least one drive section, and at least one pump piston, which is guided in a cylinder bore of a housing part of the pump in a sealed manner and which is driven by the drive section of the drive shaft at least indirectly in a lifting motion. The at least one pump piston is acted on by a spring element at least indirectly toward the drive section of the drive shaft. The spring element is disposed on the side of the drive shaft opposite the pump piston, and via a coupling device extending past the drive shaft it engages at least indirectly on the pump piston.

12 Claims, 3 Drawing Sheets

PUMP, PARTICULARLY HIGH-PRESSURE FUEL PUMP

CROSS-REFERENCE TO RELATED APPLICATION

This application is a 35 USC 371 application of PCT/EP2008/060172 filed on Aug. 1, 2008.

BACKGROUND OF THE INVENTION

1. Field of the Invention

The invention relates to a pump, in particular a high-pressure fuel pump

2. Description of the Prior Art

DE 198 48 040 A1 has disclosed such a pump in the form of a high-pressure fuel pump. This pump has at least one pump piston that is guided in a sealed fashion in a cylinder bore of a housing part of the pump. The pump also has a drive shaft provided with a drive section in the form of a cam or eccentric, which drives the at least one pump piston at least indirectly into a stroke motion. A spring element acts at least indirectly on the at least one pump piston in the direction toward the drive section of the drive shaft. During the delivery stroke of the pump piston, the drive section moves it into the cylinder bore in opposition to the force of the spring element and during the suction stroke of the pump piston, the force of the spring element moves the piston out from the cylinder bore. The spring element is embodied in the form of a cylindrical helical compression spring that is encompassed by the housing part in which the cylinder bore is provided and in which the pump piston is contained. Due to this arrangement of the spring element, the wall thickness of the housing part in its region encompassing the cylinder bore must be kept relatively thin in order to permit accommodation of the spring element. The high pressure produced during the delivery stroke of the pump piston can cause an expansion of the cylinder bore due to the relatively slight wall thickness of the housing part, so that leakage losses occur.

ADVANTAGES AND SUMMARY OF THE INVENTION

The pump according to the invention has the advantage over the prior art that arranging the spring element on the side of the drive shaft opposite from the pump piston permits the housing part to be embodied with a greater wall thickness in its region encompassing the cylinder bore so that little or no leakage losses occur due to expansion of the cylinder bore.

BRIEF DESCRIPTION OF THE DRAWINGS

An exemplary embodiment of the invention is shown in the drawings and will be explained in detail in the description that follows in conjunction with the drawings, in which.

DESCRIPTION OF THE PREFERRED EMBODIMENT

Figure 1:
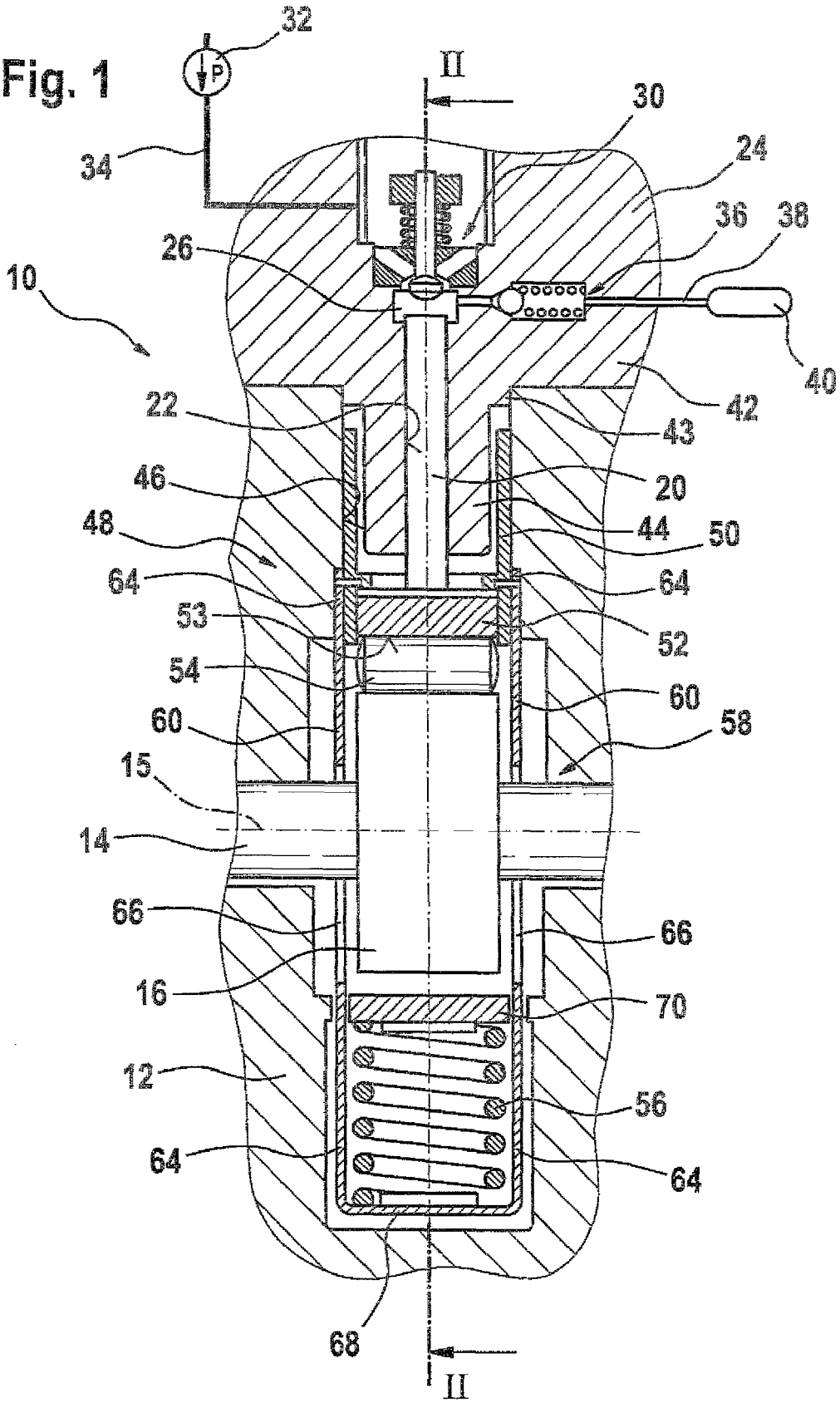
FIG. 1 shows a detail of a longitudinal section through a pump.
Figure 2:
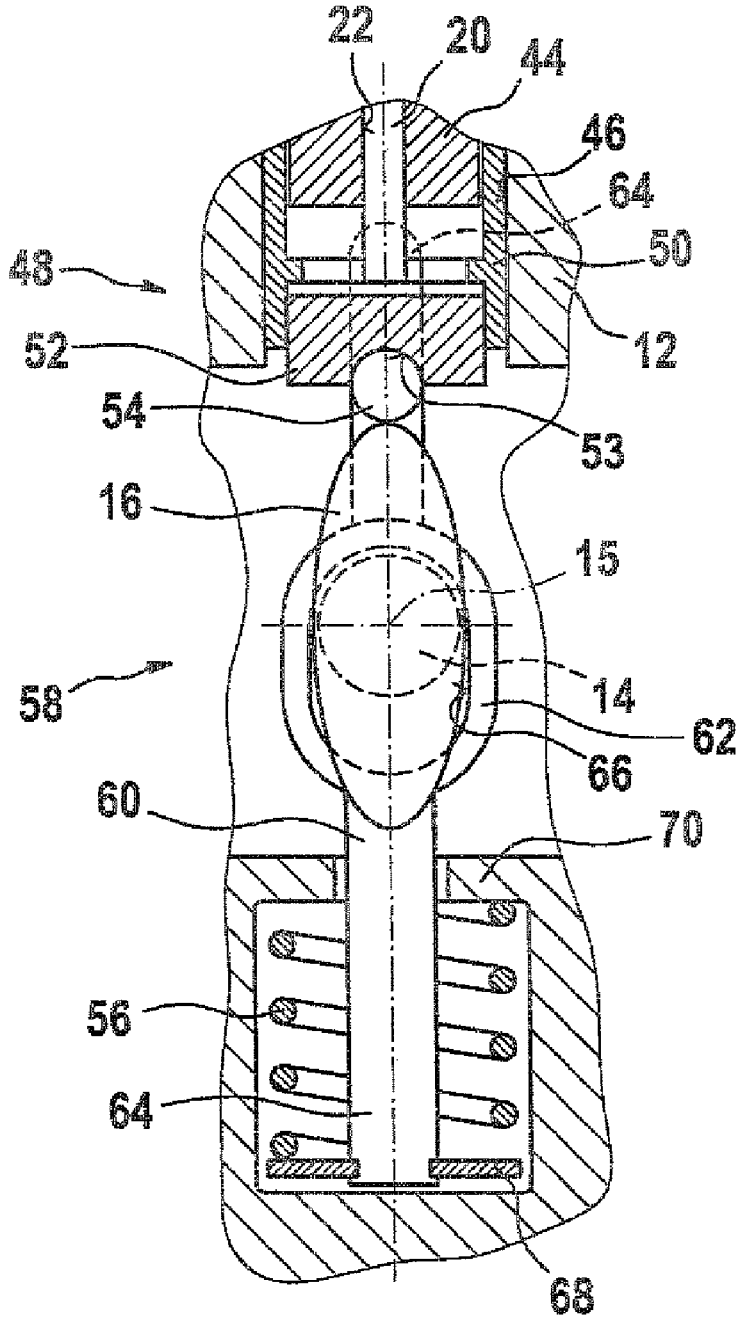
FIG. 2 shows a cross section through the pump along the line II-II from FIG. 1.
Figure 3:
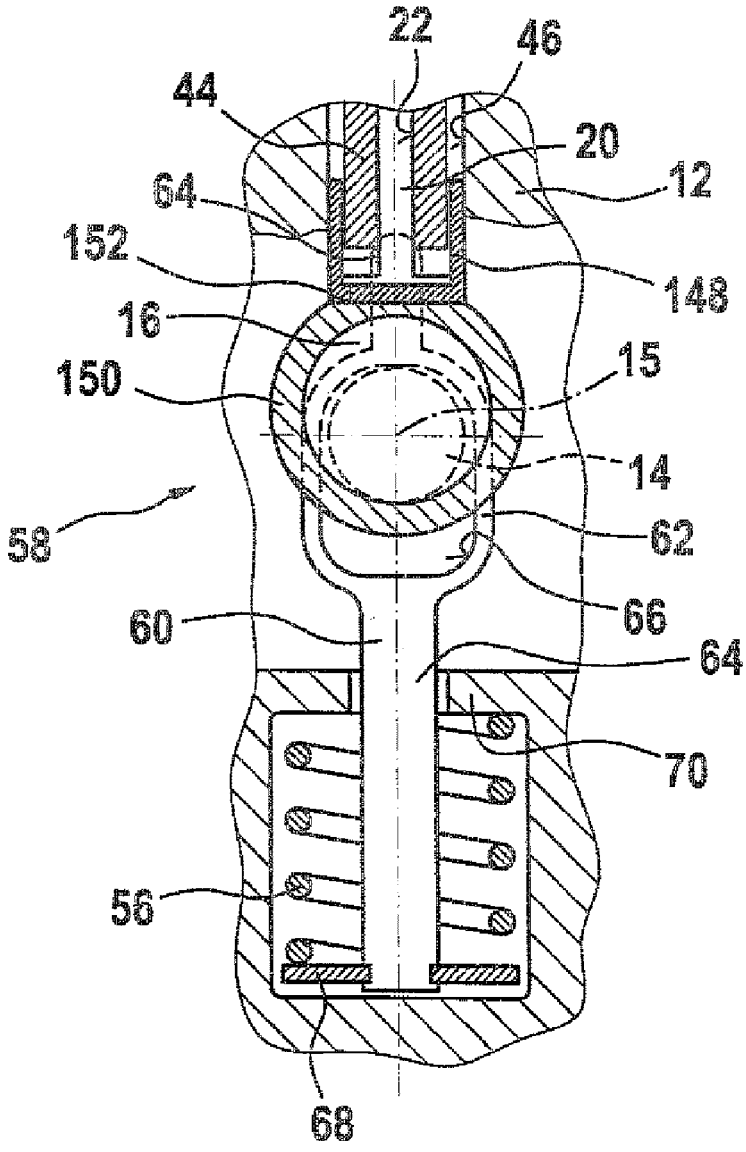
FIG. 3 shows a modified embodiment of the pump in the cross section II-II.

FIGS. 1 through 3 show a pump that is in particular a high-pressure fuel pump for a fuel injection apparatus of an internal combustion engine. The pump has a housing 10, which can be composed of multiple parts and in which, in a housing part 12, a rotary-driven drive shaft 14 is supported so that it is able to rotate around a rotation axis 15. The drive shaft 14 is supported in the housing part 12 by means of two bearing points spaced apart from each other in the direction of the rotation axis 15 of the drive shaft 14. In a region situated between the bearing points, the drive shaft 14 has at least one drive section 16, which can be embodied in the form of a cam or an eccentric. The pump has at least one pump element, possibly several pump elements, each with a respective pump piston 20 that the drive section 16 of the drive shaft 14 at least indirectly drives into a stroke motion in an at least approximately radial direction in relation to the rotation axis 15 of the drive shaft 14. The pump piston 20 is guided in a sealed fashion in a cylinder bore 22 of a housing part 24 of the pump. With its end oriented away from the drive shaft 14, the pump piston 20 delimits a pump working chamber 26 in the cylinder bore 22. Via an inlet check valve 30 that opens into it, the pump working chamber 26 communicates with an inlet 34 leading from a fuel supply pump 32, via which the pump working chamber 26 is filled with fuel during the suction stroke of the pump piston 20, which is directed radially inward toward the rotation axis 15 of the drive shaft 14. Via an outlet check valve 36 that opens out from it, the pump working chamber 26 also communicates with an outlet 38 that leads, for example, to a high-pressure fuel accumulator 40, via which fuel is displaced from the pump working chamber 26 during the delivery stroke of the pump piston 20, which is directed radially outward from the rotation axis 15 of the drive shaft 14.

The housing part 24 has a flange-like region 42, which rests against the housing part 12, and a cylindrical extension 44 that protrudes out from the region 42 and protrudes into an opening, or bore 46 in the housing part 12, and extends at least approximately radially in relation to the rotation axis 15 of the drive shaft 14. Starting from the end surface of the extension 44, the cylinder bore 22 extends through the extension 44 and into the region 42 in which the pump working chamber 26 is situated. The region 42 also contains the inlet valve 30 and the outlet valve 36. At the transition from the region 42 to the extension 44, a centering collar 43 with a greater diameter than the extension 44 is provided, which extends into the bore 46 with a small amount of play and centers the housing part 24 in relation to the housing part 12.

In the exemplary embodiment shown, the drive section 16 of the drive shaft 14 is embodied, according to FIG. 2, in the form of a double cam and the pump piston 20 rests against the double cam by means of a roller tappet 48. The roller tappet 48 includes a sleeve-shaped tappet body 50 guided via its outer casing in the bore 46 of the housing part 24, a roller support 52 inserted into the tappet body 50, and a roller 54 supported in rotating fashion in a recess 53 in the roller support 52. The roller 54 rolls against the double cam 16 and is guided in a sliding fashion in the recess 53. Alternatively, the tappet body 50 can also be guided via its inner casing against the extension 44 of the housing part 24. The pump piston 20 has a piston foot, which has a greater diameter than the region guided in the cylinder bore 22 and couples the pump piston 20 to the roller tappet 48 in the direction of its longitudinal axis.

According to a modified embodiment of the pump shown in FIG. 3, it is alternatively also possible for the drive section 16 of the drive shaft 14 to be embodied in the form of an eccentric; the pump piston 20 rests against the eccentric directly or via a tappet, for example a bucket tappet 148, or rests against a ring 150 supported on the eccentric in rotatable fashion. In the region in which it rests against the pump piston 20 or tappet 148, the ring 150 can have an at least approximately planar flattened region 152.

A spring element 56 assures that the pump piston 20 rests against the drive section 16 of the drive shaft 14 via the roller tappet 48 during the suction stroke of the pump piston 20. The spring element 56 is situated in the housing 10 of the pump, on the side of the drive shaft 14 opposite from the pump piston 20. The spring element 56 engages the pump piston 20 at least indirectly via a coupling device 58. In the exemplary embodiment shown, the coupling device 58 is attached to the tappet body 50 of the roller tappet 48 or to the tappet 148 and by means of this, is thus indirectly connected to the pump piston 20. The coupling device 58 has, for example, two support-shaped parts labeled as 60, each support 60 being respectively situated laterally next to the drive section 16 of the drive shaft 14. The supports 60 are embodied so that they have a slight thickness in the direction of the rotation axis 15 of the drive shaft 14, as shown in FIG. 1. Viewed in the direction of the rotation axis 15 of the drive shaft 14, the supports 60 each have a central hub-like region 62, as shown in FIGS. 2 and 3, with a greater width in the region of the drive shaft 14 and adjoining this, arms 64 that are reduced in width and extend radially away from the drive shaft 14. The arms 64 are situated, at least approximately, diametrically opposite each other. The hub region 62 of each support 60 is provided with a respective oblong hole 66 through which the drive shaft 14 passes. The two supports 60 of the coupling device 58 are preferably embodied identically in order to minimize production costs.

The arms 64 of the supports 60 of the coupling device 58 extending toward the tappet body 50 are connected to the tappet body 50 or to the tappet 148 at their end regions, for example by means of screws, rivets, welding, or in some other way. The arms 64 of the supports 60 of the coupling device 58 extend to approximately the height of the foot of the pump piston 20 and end spaced apart from the end surface of the extension 44 of the housing part 24. The arms 64 of the supports 60 of the coupling device 58 that are situated on the side of the drive shaft 14 oriented away from the pump piston 20 are connected to each other at their ends by means of a plate-shaped component 68. The spring element 56 is embodied, for example, in the form of a cylindrical helical compression spring and is clamped between the component 68 and a stationary support 70 situated in the housing 10 of the pump, adjacent to the drive section 16 of the drive shaft 14. The stationary support 70 here is situated a sufficient distance from the drive section 16 in order to avoid coming into contact with the drive section 16 during the rotation of the drive shaft 14.

During operation of the pump, the pump piston 20, accompanied by the roller tappet 48, executes a stroke motion. The coupling device 58 also executes this stroke motion, thus compressing and releasing the spring element 56 in alternating fashion. The oblong holes 66 in the supports 60 of the coupling device 58 enable the stroke motion of the coupling device 58 in relation to the drive shaft 14. Through the arrangement of the spring element 56 on the side of the drive shaft 14 opposite from the pump piston 20, only a slight annular gap between the extension 44 of the housing part 24 and the bore 46 in the housing part 12 is required to accommodate the tappet body 50. The tappet body 50 here can be embodied with a slight wall thickness so that the annular gap can be kept correspondingly narrow. This permits an embodiment of the extension 44 of the housing 24 with a substantial wall thickness all the way to its end surface, thus resulting in only a slight expansion of the cylinder bore 22 due to the action of the high pressure in the pump working chamber 26 during the delivery stroke of the pump piston 20 and the occurrence of correspondingly low leakage losses from the pump working chamber 26.

In the above description, only one pump piston 20 is explained; the pump can also have several pump pistons 20, for example two of them. The two pump pistons 20 in this case can be arranged rotationally offset from each other by an angle of approximately 90° around the rotation axis 15 of the drive shaft 14; each pump piston 20 is then engaged via a coupling device 58 by the associated spring element 56 situated on the side of the drive shaft 14 opposite from the pump piston 20. The coupling devices 58 of the two pump pistons 20 in this case preferably extend toward the rotation axis 15 of the drive shaft 14 offset from each other so that they do not hinder each other.

The foregoing relates to the preferred exemplary embodiments of the invention, it being understood that other variants and embodiments thereof are possible within the spirit and scope of the invention, the latter being defined by the appended claims.

The invention claimed is:

1. A high-pressure fuel pump, comprising:

a housing;

a rotary-driven drive shaft that has at least one drive section extending along the drive shaft;

at least one pump piston, which is guided in a sealed fashion in a cylinder bore of a housing part of the pump, and is driven at least indirectly into a stroke motion by the drive section of the drive shaft; and a spring element that acts at least indirectly on the at least one pump piston in a direction toward the drive section of the drive shaft, the spring element, being situated on a side of the drive shaft opposite from the pump piston, engaging the pump piston at least indirectly via a coupling device extending past the drive shaft, wherein the coupling device has two parts, each of which is situated laterally outside respective ends of the drive section, each being adjacent to the drive section of the drive shaft, and each part being connected at least indirectly to the pump piston.

2. The pump as recited in claim 1, wherein each of the two parts of the coupling device has a respective oblong hole through which the drive shaft passes.

3. The pump as recited in claim 2, wherein the drive shaft has a rotation axis, and when viewed in the direction of the rotation axis of the drive shaft, each of the parts of the coupling device has a respective middle region, which has a widened width and in which the oblong hole is situated, and two arms of a narrower width situated opposite each other and extending away from the middle region.

4. The pump as recited in claim 3, wherein end regions of the arms of the parts of the coupling device oriented toward the pump piston are at least indirectly connected to the pump piston.

5. The pump as recited in claim 2, wherein the arms of the coupling device have end regions, and the spring element is clamped between the end regions of the arms of the coupling device oriented away from the pump piston and a stationary support situated close to the drive shaft.

6. The pump as recited in claim 3, wherein the arms of the coupling device have end regions, and the spring element is clamped between the end regions of the arms of the coupling device oriented away from the pump piston and a stationary support situated close to the drive shaft.

7. The pump as recited in claim 1, wherein the pump piston rests against the drive section of the drive shaft via a support element and the coupling device is connected to the support element.

8. The pump as recited in claim 2, wherein the pump piston rests against the drive section of the drive shaft via a support element and the coupling device is connected to the support element.

9. The pump as recited in claim 3, wherein the pump piston rests against the drive section of the drive shaft via a support element and the coupling device is connected to the support element.

10. The pump as recited in claim 4, wherein the pump piston rests against the drive section of the drive shaft via a support element and the coupling device is connected to the support element.

11. The pump as recited in claim 5, wherein the pump piston rests against the drive section of the drive shaft via a support element and the coupling device is connected to the support element.

12. The pump as recited in claim 6, wherein the pump piston rests against the drive section of the drive shaft via a support element and the coupling device is connected to the support element.

* * * * *